US005131134A

United States Patent [19]

Quambusch et al.

[11] Patent Number: 5,131,134

[45] Date of Patent: Jul. 21, 1992

[54] APPARATUS TO COIL STRIP

[75] Inventors: Herbert Quambusch, Ratingen; Helmut Pecnik, Moers; Peter Jollet, Düsseldorf, all of Fed. Rep. of Germany

[73] Assignee: Mannesmann Aktiengesellschaft, Düsseldorf, Fed. Rep. of Germany

[21] Appl. No.: 690,708

[22] Filed: Apr. 24, 1991

[30] Foreign Application Priority Data

Apr. 24, 1990 [DE] Fed. Rep. of Germany ..... 4013582

[51] Int. Cl.[5] ..... B23P 17/00; B23P 23/04

[52] U.S. Cl. ..... 29/527.7; 72/128; 72/148; 72/202; 432/59; 432/65; 29/33 S

[58] Field of Search ..... 29/527.7, 33 S; 72/128, 72/148, 200, 202; 432/59, 65

[56] References Cited

U.S. PATENT DOCUMENTS

| | | | |
|---|---|---|---|
| 2,658,741 | 11/1953 | Schmidt et al. | 263/3 |
| 3,883,295 | 5/1975 | Lowderman et al. | 432/138 |
| 4,012,028 | 3/1977 | Dunaevsky et al. | 266/103 |
| 4,048,831 | 9/1977 | Fabian et al. | 72/251 |
| 4,075,747 | 2/1978 | Hague et al. | 29/18 |
| 4,086,472 | 4/1978 | Sikora | 236/92 |
| 4,124,415 | 11/1978 | Sporenberg et al. | 148/13 |
| 4,184,350 | 1/1980 | Horwitt | 72/132 |
| 4,213,231 | 7/1980 | Middlemiss et al. | 29/18 |
| 4,384,468 | 5/1983 | Ginzburg | 72/202 |
| 4,430,870 | 2/1984 | Winter et al. | 66/210 |
| 4,442,690 | 4/1989 | Hirschmannes | 72/202 X |
| 4,529,138 | 7/1985 | Perschka | 242/4 |
| 4,602,967 | 7/1986 | Komma et al. | 148/9 |
| 4,608,014 | 8/1986 | Buchegger et al. | 432/59 |
| 4,630,352 | 12/1986 | Ginzburg et al. | 29/527.7 |
| 4,691,874 | 9/1987 | Inamori et al. | 242/80 |
| 4,703,640 | 11/1987 | Buchegger et al. | 72/202 X |
| 4,768,364 | 9/1988 | Kovaleski et al. | 72/132 |
| 4,942,656 | 7/1990 | Benedetti et al. | 29/527.6 |
| 5,009,092 | 4/1991 | Buchegger | 72/202 X |

FOREIGN PATENT DOCUMENTS 0177187 4/1986 European Pat. Off. .

*Primary Examiner*—Carl J. Arbes

*Attorney, Agent, or Firm*—Nils H. Ljungman & Associates

[57] ABSTRACT

An apparatus for coiling strip, in particular, continuously cast thin slabs, which after leaving the continuous caster are wound into a coil in a furnace at a casting speed, and are payed out of this furnace at a rolling speed, whereby preferably two furnaces are preferably located one above the other for alternating coiling and payout. To improve an apparatus of the type described above for the coiling of strip which has only small thermal losses in a largely closed furnace, and has the smallest possible number of moving parts inside the furnace to achieve a high degree of operational safety and reliability. The invention proposes that each furnace has a threading opening for the strip which is largely closed by a pair of pinch rolls, and together with the pair of pinch rolls, can be pivoted around its horizontal axis, which corresponds to the coiling axis, from the coiling position into the payout position.

20 Claims, 3 Drawing Sheets

APPARATUS TO COIL STRIP

BACKGROUND OF THE INVENTION

1. Field of the Invention

This invention relates to an apparatus for coiling material in the form of strip, in particular to the coiling of continuously cast thin slabs. After leaving the continuous casting line, the strip is wound into a coil in a furnace at a casting speed, and subsequently payed off from the coil at a rolling speed. Preferably two furnaces, one preferably located above the other, are used for alternating coiling and payoff of the strip.

2. Background Information

In the production of hot-rolled strip from continuously cast primary material, there is a difference between the speed of continuous casting and the speed of rolling. Measures must therefore be taken in industrial plants to compensate for the speed difference. These measures include the temporary storage of the strip. One such method involves winding the primary material into coils, with the coiling process preferably taking place in a furnace in order to achieve uniform temperature conditions for the reprocessing of the strip when it is subsequently payed out into the rolling mill. To avoid work interruptions, it has been proposed that two coiling devices be used in the furnace, one preferably being located above the other, so that while the first coiling device is winding up strip, the other coiling device can be paying off strip; see European Patent No. A1 01 77 187. These furnaces preferably include separator-like devices to deflect the strip on both the entrance and the exit side of the furnace, and winding devices for coiling and paying out the strip from the furnace. However, such devices necessitate correspondingly large openings in the furnace for the entrance and exit of the strip. Further, the pivoting back-up rolls, pivoting tables and coil opening chisels, which are conventionally employed for coiling and paying out the strip, most often operate inside the furnace and represent disruptive factors However, the ma]or problem of the known devices is presented by the large openings which must exist on both sides of the furnace, and which represent a significant thermal loss for the strip being wound. Such openings also have an adverse effect on the operation of the furnace.

OBJECTS OF THE INVENTION

Given the above stated problems and shortcomings, the objects of the present invention are to improve an apparatus of the type described above for the coiling of strip, so that only minor thermal losses occur when the opening of the furnace is completely closed, and to guarantee a high degree of operational safety and reliability by having the fewest possible number of moving parts inside the furnace.

SUMMARY OF THE INVENTION

These objects are achieved by the present invention, in that each furnace has an inlet opening for the strip which, inlet opening can be substantially closed by a pair of pinch rolls. Both the pair of pinch rolls and the furnace itself can be pivoted around the horizontal axis of the furnace, which axis is also the winding axis, into the payout position.

In the embodiment of the present invention, only one opening per furnace is required since the entire furnace can be pivoted from the entrance, or take up, position into the payout position, and since each of the two furnaces has one pair of pinch rolls intended for both the introduction and the payout of the strip. The pair of pinch rolls also substantially closes the furnace opening to thereby minimize the thermal loss, and render the majority of the moving parts required in the known furnaces unnecessary.

In one configuration of the invention, there is a winding shaft inside the furnace which picks up the beginning of the strip. The winding shaft is aligned with the pair of pinch rolls, and a guide table is located therebetween. This configuration enables the beginning of the strip to be easily and automatically threaded into the winding shaft without the need for pivoting backup rolls, separators and other moving parts inside the furnace.

Another particularly advantageous feature of the invention is that the guide table, in its resting position, forms a part of the furnace wall. Thus, when the guide table is not in use, it forms part of the furnace wall, and when the strip is to be threaded into the furnace, the guide table can be pivoted from a resting position into alignment inside the furnace. As a part of the furnace wall, the guide table can have all the moving parts located outside the furnace, which increases operational safety and reliability. Only when the strip is being threaded is the guide table briefly pivoted inward, whereby a lever system, having appropriately designed pivot and guide elements for moving the guide table, can remain outside the furnace. The guide table can be pivoted back into place as part of the furnace wall immediately after the beginning of the strip has been threaded, and thereby close the opening that was temporarily formed in the wall of the furnace.

One aspect of the invention resides broadly in an apparatus for the coiling of strip, the apparatus comprising: at least one furnace having a periphery being substantially closed to retain heat within the furnace; the at least one furnace having an aperture arrangement; the aperture arrangement disposed on the periphery of the at least furnace for permitting entry and exit of the strip; an opening and closing device located at the aperture arrangement for opening and closing the aperture of the at least one furnace; and coiling device located within the at least one furnace, the coiling device for coiling the strip entering the at least one furnace.

BRIEF DESCRIPTION OF THE DRAWINGS

The following description of the preferred embodiments may be better understood when taken in conjunction with the appended drawings in which.

DESCRIPTION OF THE PREFERRED EMBODIMENTS

Figure 1:
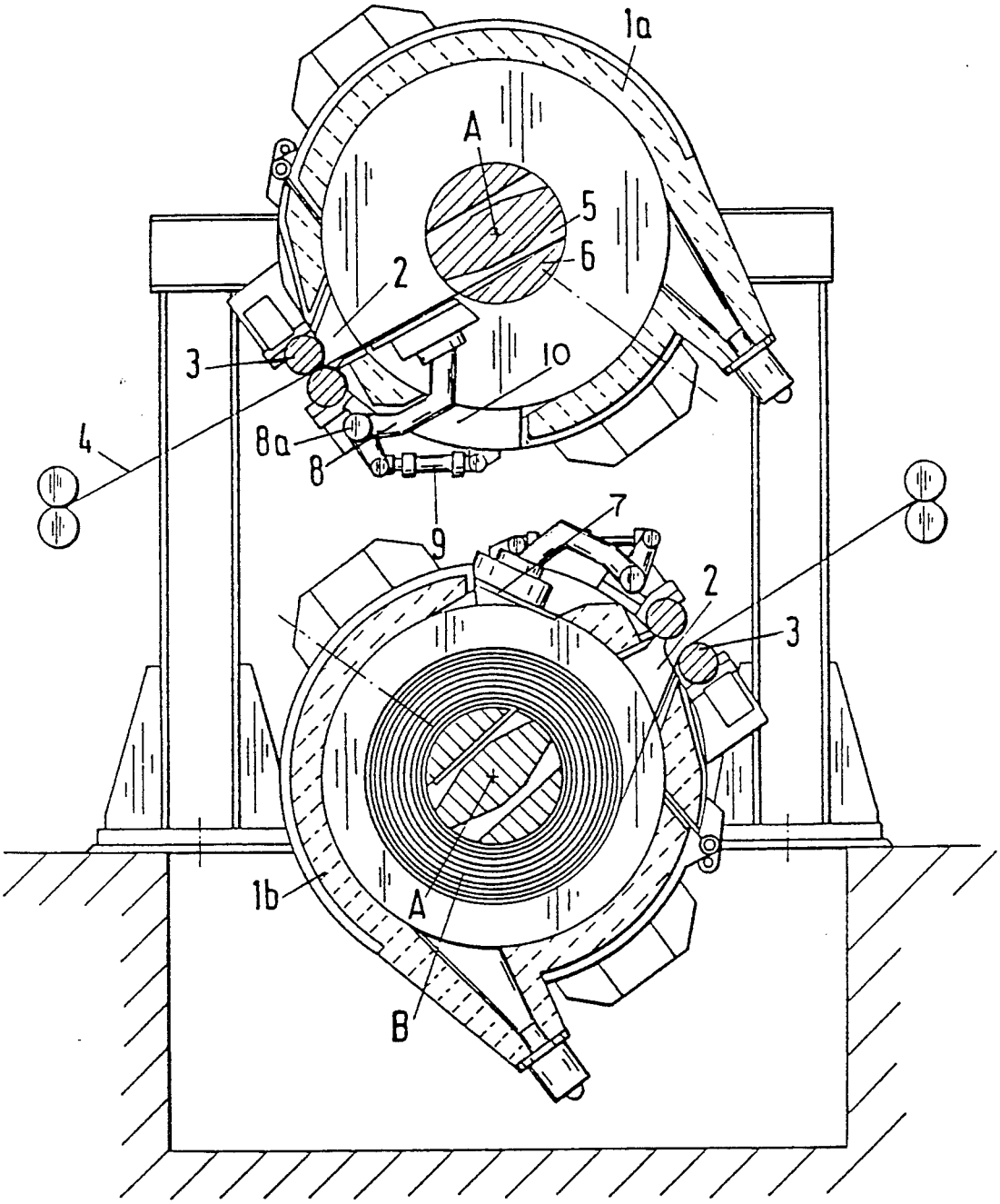
FIG. 1 is a schematic diagram showing a side view of the apparatus for the coiling of strip according to the present invention.

As shown in FIG. 1, preferably two substantially identical furnaces 1*a* and 1*b* can each be pivoted around their horizontal axes A by approximately 180 degrees, so that they can be pivoted from the coiling position, as shown by the top furnace 1*a*, into the payout position, as shown by the bottom furnace 1*b*. Both furnaces have an inlet/outlet opening 2, which is substantially closed by the pair of pinch rolls 3. As shown by furnace 1*a*, which is in the coiling phase, the pair of pinch rolls 3 guides the strip 4 into slot 5 on the winding shaft 6, whereby the guide table 7, described below, provides additional support for the strip 4 as the strip 4 is being fed into the slot 5. After strip 4 is fed into slot 5, strip 4 is wound upon winding shaft 6 to form coil B. After several turns of the coil B have been wound, the pair of pinch rolls 3 are retracted from the strip surface, and leave a gap for the strip 4. However, the pinch rolls 3 still substantially close off the inlet/outlet opening 2, as illustrated in furnace 1*b* which is in the payout position.

For the coiling process, illustrated by furnace 1*a*, the guide table 7 is pivoted by means of a lever linkage 8 and a piston-cylinder unit 9 so that the guide table 7 is aligned between the pair of pinch rolls 3 and the slot 5 in the winding shaft 6. Lever linkage 8 pivots on hinge structure 8*a*. The guide table 7 is designed so that in its resting position, as shown in furnace 1*b*, it forms a part of the wall of the furnace 1*b*, whereby all the moving parts of the guide table 7 are located outside of the furnace 1*b*. This part of the furnace wall formed by guide table 7 is pivoted inward only briefly for the winding of the strip, as is shown by furnace 1*a*, thereby creating a furnace wall opening 10 which for a short period of time essentially does not upset the thermal balance of the furnace.

Figure 2:
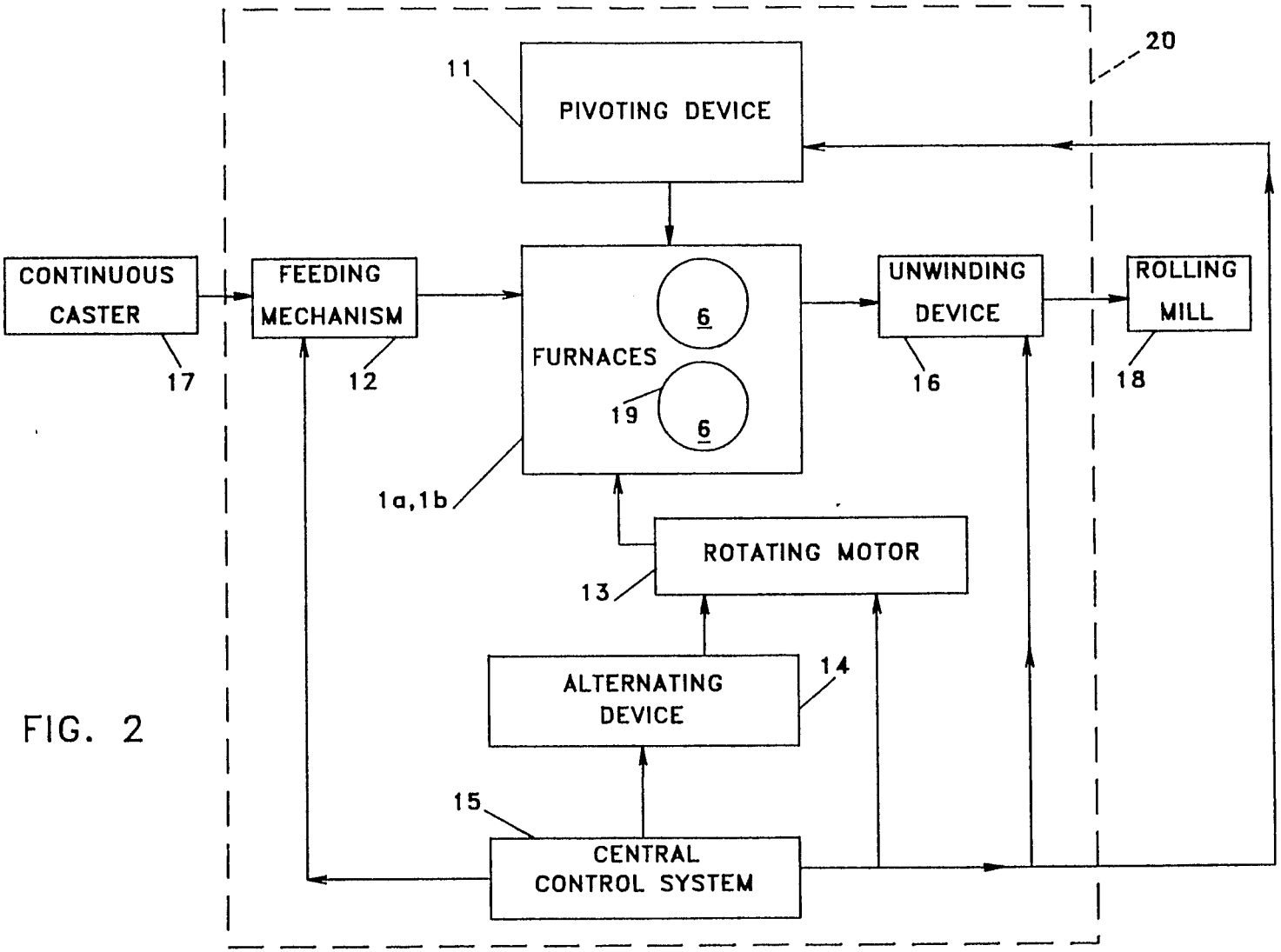
FIG. 2 is a block diagram of the apparatus for the coiling of strip.

As shown in FIG. 2, the furnaces 1*a*, 1*b* are preferably located between a continuous caster 17 and a rolling mill 18.

The feeding mechanism 12, which is controlled by a central control system 15, threads strip from the continuous caster 17 into the apparatus for the coiling of strip 20, which preferably comprises two furnaces 1*a*, 1*b* each having a winding shaft 6 upon which the strip is wound. The winding shaft 6 is rotated by a rotating device 13, the speed of which is regulated by the central control system 15. The furnaces 1*a*, 1*b* can be pivoted by a pivoting device 11, from a coiling position to a position for paying out the strip 4 to the rolling mill 18. An alternating device 14 switches the winding shaft 6 from a coiling to an uncoiling mode. Both the pivoting mechanism 11 and the alternating device 14 are controlled by the central control system 15. The strip 4 is then uncoiled from the winding shaft 6 through an unwinding device 16, which is also preferably controlled by the central control system 15, into rolling mill 18. Alternatively, the central control system 15 could utilize a separate control system for each of the various components, which include the pivoting device 11, the feeding mechanism 12, the rotating device 13, the alternating device 14, the unwinding device 16, and the pivoting mechanism 19.

Figure 3:
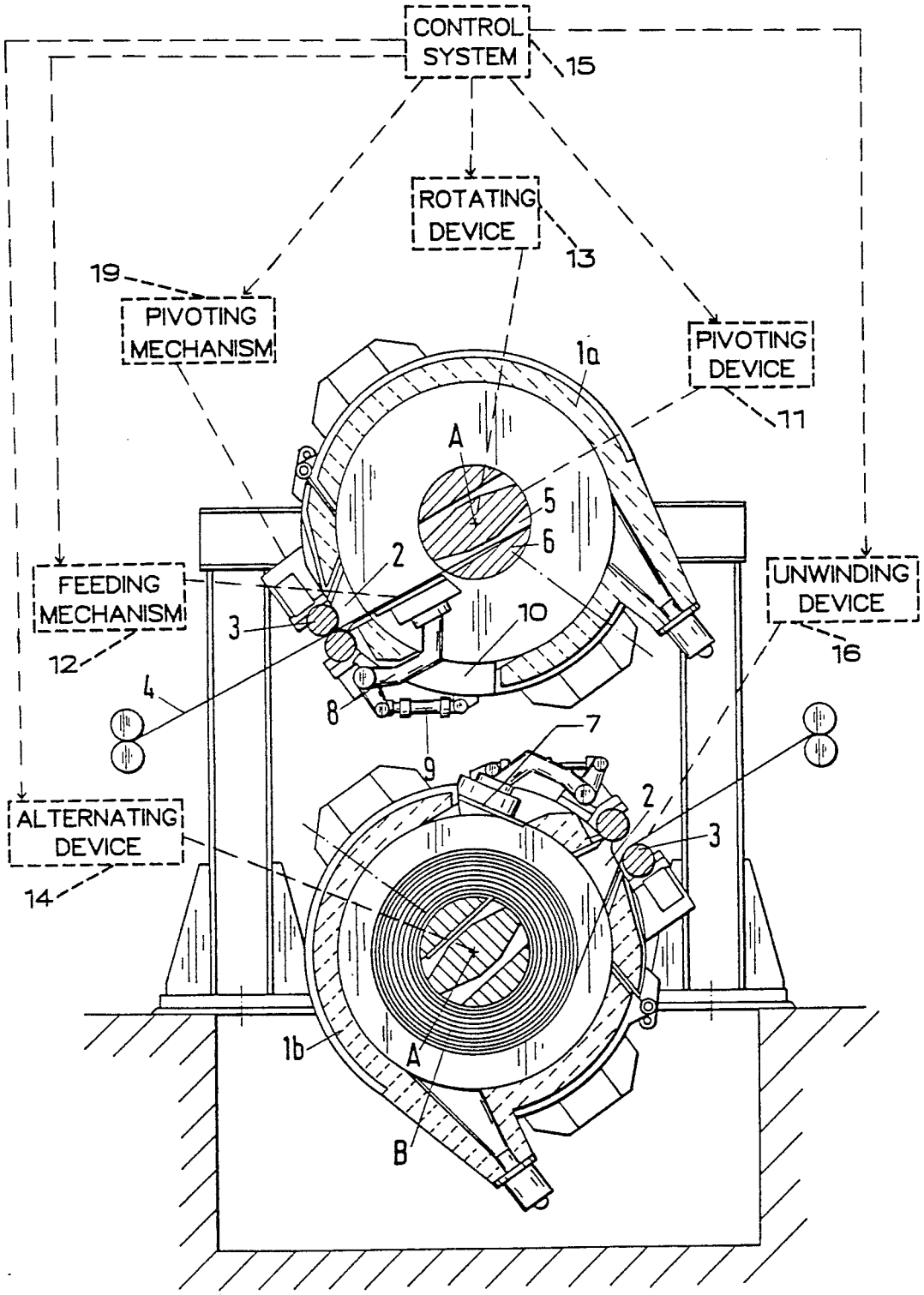
FIG. 3 is a second schematic diagram showing a side view of the apparatus for the coiling of strip which diagram corresponds generally to FIG. 1, with additional structures included therein.

In FIG. 3, the strip 4, produced by the continuous caster 17 of FIG. 2 is fed through the feeding mechanism 12 and into the furnace la which is positioned for coiling the strip 4. As described above, the strip 4 enters through the inlet opening 2, the size of which is essentially determined by the separation of the pinch rolls 3. The pinch rolls 3 are pivoted into place by a pivoting mechanism 19, such as a pneumatic cylinder, which can preferably be controlled by the central control system 15. At the same time, the guide table 7 is maneuvered into alignment between the opening 2 and the slot 5 of the winding shaft 6 by the piston-cylinder unit 9 which can also be a pneumatic cylinder. A possible embodiment of the invention would involve connecting the pivoting mechanism 19 and the piston-cylinder 9 such that the guide table 7 would be moved into place when the pinch rolls 3 are moved.

The strip 4 is then guided by the guide table 7 into the slot 5 of the winding shaft 6 The winding shaft 6 is turned by the rotating device 13, the speed of which is regulated by the central control system 15. After the winding of the strip 4 onto the coil B has substantially begun, the guide table 7 is preferably retracted to its resting position shown in the furnace 1*b*. The place in which the guide table 7 rests is preferably the furnace wall opening 10, as shown in the furnace 1*a*.

When pay out of the strip 4 from the coil B is desired, the furnace la is pivoted about its horizontal axis A, by the pivoting device 11 operated through the central control system 15, from a coiling position as shown by the furnace 1*a*, to a payout position as shown by the furnace 1*b*. The opening 2 is thus positioned for uncoiling of the strip 4 via the unwinding device 16 into the rolling mill 18 of FIG. 2. In one possible embodiment, the pinch rolls 3 pinch the strip 4 while the strip 4 is being uncoiled from the winding shaft 6. The alternating device 14 regulated by the central control system 15 changes the rotating device 13 from a coiling to an uncoiling mode. The speed of rotation of the winding shaft 6 is also changed from a faster casting speed to a slower rolling speed by rotating device 13. The strip 4 is then payed out into the rolling mill 18 of FIG. 2.

The invention advantageously creates a furnace which makes it possible to coil and pay out strip with a minimum number of moving parts and also without significant thermal losses from the furnaces. This represents a surprisingly simple and economical solution to the problems of the known furnaces.

An example of a possible feeding mechanism may be found in U.S. Pat. No. 4,075,747 entitled "Manufacture of Metal Strip", U.S. Pat. No. 4,529,138 entitled "Strip Core Winder for Core-Coil Assembly", U.S. Pat. No. 4,768,364 entitled "continuous Coiling Machine for Rod and Strip Stock", U.S. Pat. No. 4,942,656 entitled "Plant and Method for the Temperature-Equalization of Slabs Downstream of a continuous Casting Plant", U.S. Pat. No. 4,184,350 entitled "High-Production Method and Apparatus for Making Spiral Convolution electrical Heating Coils", U.S. Pat. No. 4,124,415 entitled "Process for Heating Metal Strips, In Particular Non-Ferrous Metal Strips", or U.S. Pat. No. 4,602,967 entitled "Method and Apparatus for Thermal Longitudinal Parting of Rectangular Metal Plate Bars, In Particular of Cut-to-Length Continuous-Casting Plate Slabe".

An example of a possible central control system may be found in U.S. Pat. No. 4,086,472 entitled "Apparatus for Controlling the Laying of Strip Material" or U.S. Pat. No. 4,213,231 entitled "Manufacture of Metal Strip".

An example of a possible rotating device may e found in U.S. Pat. No. 4,213,231 entitled "Manufacture of Metal Strip", U.S. Pat. No. 4,086,472 entitled "Apparatus for Controlling the Laying of Strip Material", U.S. Pat. No. 4,768,364 entitled "Continuous Coiling Machine for Rod and Strip Stock", U.S. Pat. No. 3,883,295 entitled "Rotarty Hearth Furnace", or U.S. Pat. No. 4,691,874 entitled "Method and Apparatus for Winding Wire Rod".

An example of a possible alternating mechanism may be found in U.S. Pat. No. 4,124,415 entitled "Process for heating Metal Strips, In Particular Non-ferrous Metal Strips" or U.S. Pat. No. 3,883,295 entitled "Rotary Hearth Furnace."

An example of a possible pivoting device may be found in U.S. Pat. No. 4,048,831 entitled "Two-Roller Driving Device".

An example of a possible unwinding device maybe found in U.S. Pat. No. 4,942,656 entitled "Plant and Method for the Temperature-Equalization of Slabs Downstream of a continuous Casting Plant", or U.S. Pat. No. 4,602,967 entitled "Method and Apparatus for Thermal Longitudinal Parting of Rectangular Metal Plate Bars, In Particular of Cut-to-Length Continuous-Casting Plate Slabs".

One aspect of the invention resides broadly in an apparatus for the coiling of strip, in particular continuously cast thin slabs, which after leaving the continuous caster are wound up into a coil in a furnace at the casting speed, and are payed out of this furnace at the rolling speed, whereby two furnaces are located on above the other for alternating coiling and payout, characterized by the fact that each furnace 1*a*, 1*b* has a threading opening 2 for the strip 4 which is largely closed by a pair of pinch rolls 3, and together with this pair of pinch rolls 3 can be pivoted around its horizontal axis A which is same as the winding axis from the coiling position into the payout position.

Another aspect of the invention resides broadly in an apparatus characterized by the fact that inside each furnace 1*a*, 1*b*, in line with the pair of pinch rolls 3, there is a winding shaft 6 which holds the beginning of the strip, and that a guide table 7 can be pivoted between the winding shaft 6 and the pair of pinch rolls 3.

Yet another aspect of the invention resides broadly in an apparatus characterized by the fact that the guide table 7 represents a part of the furnace wall which can be briefly pivoted inside the furnace 1*a*, 1*b* to thread the strip 4, forming an opening in the furnace wall.

All of the patents, recited herein, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A method for coiling strip formed by a continuous caster, coiling the strip onto a furnace and paying off of the strip from the furnace, said furnace having a periphery, said periphery having an aperture, said method comprising:

positioning the furnace to permit feeding the strip through the aperture in the periphery of the furnace;

said furnace comprising opening and closing means for opening and closing said aperture;

closing said opening and closing means around the strip as the strip passes through the aperture;

said furnace comprising winding means for coiling the strip;

winding the strip into a coil about said winding means;

pivoting the furnace from a coiling position to a payout position;

paying outsaid coil through said aperture.

2. The method of claim 1, wherein:

said furnace comprises a guide table and a pivoting arm, said guide table for guiding the strip into said winding means, said pivoting arm for moving said guide table into alignment with said closing and opening means and said winding means for guiding the strip into said winding means;

guiding the strip form the aperture to the winding means with said guide table.

3. The method of claim 2, wherein:

said opening and closing means comprises a pair of pinch rollers for pinching the strip and closing the aperture and said pair of pinch rollers also for opening the aperture;

controlling said winding means to wind said strip from said continuous caster at a casting speed;

controlling said winding means to pay out said strip at a speed for processing the strip in a rolling mill;

alternatively pivoting eh furnace between a coiling position and a pay out position;

said furnace comprises a first furnace and a second furnace, wherein said first furnace is disposed substantially about said second furnace; and alternating operation of said winding means of said first furnace to coil the strip from said continuous caster substantially when said winding means of said second furance pays out the strip to said rolling mill, alternately with operation of said winding means of said first furnace to pay out the strip to said rolling mill substantially when said winding means of said second furnace coils the strip from said continuous caster.

4. An apparatus for the coiling of strip, said apparatus comprising:

at least on furnace having a periphery being substantially closed to retain heat within said furnace;

said at least one furnace having aperture means;

said aperture means being located on said periphery of said at least one furnace for permitting entry and exit of the strip into and out of said at least one furnace;

an opening and closing means being operatively associated with said aperture means, said opening and closing means being for opening and closing said aperture of said at least one furnace; and coiling means being operatively associated wit said at lest one furnace and being located within said at least one furnace, said coiling mean for coiling the strip entering said at least one furnace.

5. An apparatus for coiling strip according to claim 4, wherein said at least one furnace has a central axis, said at least one furnace being pivotable about said central axis, and said opening and closing means pivoting switch said at least one furnace.

6. An apparatus for coiling of strip according to claim 5, wherein said opening and closing means comprises a pair of pinch rollers for pinching the strip.

7. An apparatus for coiling of strip according to claim 6, wherein said coiling mean comprises means for winding the strip, and means for guiding the strip onto said winding means;

said guiding means comprising a guide table and a pivoting arm, said guide table for guiding the strip onto said winding means, and said pivoting arm for moving said guide table into alignment with said pair of pinch rolls and said winding means;

said pivoting arm comprising hinge means and lever means;

said hinge means of said pivoting arm being operatively associated with said periphery of said at least one furnace; and said lever means connecting said hinge means to said guide table.

8. An apparatus for coiling of strip according to claim 7, wherein said periphery of said at least one furnace has a recess; and said pivoting arm is also for moving said guide table to fill said recess.

9. An apparatus for coiling of strip according to claim 8, wherein:

said winding means is rotatable about said central axis of said at least one furnace; and said winding means comprises a winding shaft having slot means for holding the strip entering said at least one furnace.

10. An apparatus for coiling of strip according to claim 9, wherein said at least one furnace is disposed between a continuous caster and a rolling mill;

said strip for coiling comprises continuous cast slabs; and said continuous cast slabs entering said at least one furnace from said continuous caster at a casting speed.

11. An apparatus for coiling of strip according to claim 10, wherein said at least one furnace is pivotable approximately 180° about said central axis between a winding position and an unwinding position;

said central axis of rotation is a horizontal axis; and said at least one furnace further comprises means for pivoting, said means for pivoting for pivoting said at least one furnace between said winding position and said unwinding position.

12. An apparatus for coiling of strip according to claim 11, further comprising a first furnace and a second furnace.

13. An apparatus for coiling of strip according to claim 12, wherein:

said first furnace is disposed substantially above said second furnace;

said apparatus comprises means for rotating said winding means at different speeds; and said apparatus comprises control means for controlling the speed of said means for rotating.

14. An apparatus for coiling of strip according to claim 4, wherein said opening and closing means comprises a pair of pinch rollers for pinching the strip.

15. An apparatus for coiling of strip according to claim 14, wherein said coiling means comprised means for winding the strip, and means for guiding the strip onto said winding means;

said guiding means comprising a guide table and a pivoting arm, said guide table for guiding the strip onto said winding means, and said pivoting arm for moving said guide table into alignment with said pair of pinch rolls and said winding means;

said pivoting arm comprising hinge means and lever means;

said hinge means of said pivoting arm being operatively associated with said periphery of said at least one furnace; and said lever means connecting said hinge means to said guide table.

16. An apparatus for coiling of strip according to claim 15, wherein said periphery of said at least on furnace has a recess; and said pivoting arm is also for moving said guide table to fill said recess.

17. An apparatus for coiling of strip according to claim 16, wherein said winding means comprises a winding shaft having slot means for holding the strip entering said at least one furnace.

18. An apparatus for coiling of strip according to claim 17, wherein said at least one furnace is disposed between a continuous caster and a rolling mill;

said strip for coiling comprises continuous cast slabs; and said continuous cast slabe entering said at least one furnace from said continuous caster at a casting speed.

19. An apparatus for coiling of strip according to claim 18, further comprising a first furnace and a second furnace.

20. An apparatus for coiling of strip according to claim 19, wherein:

said first furnace is disposed substantially above said second furnace;

said apparatus comprises means or rotating said winding means at different speeds; and said apparatus comprises control means for controlling the speed of said means for rotating.

* * * * *

UNITED STATES PATENT AND TRADEMARK OFFICE

CERTIFICATE OF CORRECTION

PATENT NO. : 5,131,134

DATED : July 21, 1992

INVENTOR(S) : Herbert QUAMBUSCH, Helmut PECNIK, Peter JOLLET

It is certified that error appears in the above-identified patent and that said Letters Patent is hereby corrected as shown below:

Column 4, line 54, delete " Slabe". " and insert --Slabs".--.

Column 4, line 66, after 'entitled', delete "Rotarty" and insert --Rotary--.

Column 5, line 22, after 'located', delete "on" and insert --one--.

Column 5, line 67, Claim 1, after 'paying', delete "outsaid" and insert --out said--.

Column 6, line 7, Claim 2, after 'strip', delete "form" and insert --from--.

Column 6, line 18, Claim 3, delete "alternatively pivoting eh" and insert --alternately pivoting the--.

Column 6, lines 21-22, Claim 3, after 'substantially', delete "about" and insert --above--.

Column 6, line 35, Claim 4, after 'least', delete "on" and insert --one--.

UNITED STATES PATENT AND TRADEMARK OFFICE

CERTIFICATE OF CORRECTION

PATENT NO. : 5,131,134

DATED : July 21, 1992

INVENTOR(S) : Herbert QUAMBUSCH, Helmut PECNIK, Peter JOLLET

It is certified that error appears in the above-identified patent and that said Letters Patent is hereby corrected as shown below:

Column 6, line 46, Claim 4, after 'associated', please delete "wit" and insert --with--.

Column 6, line 47, Claim 4, before 'one', delete "lest" and insert --least--.

Column 6, line 48, Claim 4, after the first occurrence of 'coiling', delete "mean" and insert --means--.

Column 6, line 54, Claim 5, before 'said', delete "switch" and insert --with--.

Column 8, line 5, Claim 15, after the first occurrence of 'means', delete "comprised" and insert --comprises--.

UNITED STATES PATENT AND TRADEMARK OFFICE

CERTIFICATE OF CORRECTION

PATENT NO. :5,131,134

DATED :July 21, 1992

INVENTOR(S) :Herbert Quambausch, Helmut Pecnik, Peter Jollet

It is certified that error appears in the above-identified patent and that said Letters Patent is hereby corrected as shown below:

Column 8, line 21, claim 16, after 'least', delete "on" and insert --one--.

Column 8, line 34, claim 18, after 'cast', delete "slabe" and insert --slabs--.

Signed and Sealed this

Sixteenth Day of November, 1993

*Attest:*

*Attesting Officer*

BRUCE LEHMAN

*Commissioner of Patents and Trademarks*